US005751265A

United States Patent [19]

Han

[11] Patent Number: 5,751,265

[45] Date of Patent: May 12, 1998

[54] APPARATUS AND METHOD FOR PRODUCING SHADED IMAGES ON DISPLAY SCREENS

[75] Inventor: Robin Sungsoo Han, Saratoga, Calif.

[73] Assignee: Cirrus Logic, Inc., Fremont, Calif.

[21] Appl. No.: 442,836

[22] Filed: May 16, 1995

Related U.S. Application Data

[63] Continuation of Ser. No. 813,036, Dec. 24, 1991, abandoned, and Ser. No. 865,031, Apr. 7, 1992, abandoned, which is a continuation-in-part of Ser. No. 813,036.

[51] Int. Cl.[6] ..... G09G 3/36

[52] U.S. Cl. ..... 345/88; 345/89; 345/148; 345/149

[58] Field of Search ..... 345/88, 89, 113, 345/136, 139, 147–150, 152, 153; 382/169; 358/429, 455

[56] References Cited

U.S. PATENT DOCUMENTS

| | | | |
|---|---|---|---|
| 3,716,658 | 2/1973 | Rackman | 178/7.3 D |
| 3,735,182 | 5/1973 | Dalton et al. | 313/188 |
| 3,937,878 | 2/1976 | Judice | 340/767 |
| 3,955,187 | 5/1976 | Bigelow | 340/324 M |
| 4,100,579 | 7/1978 | Ernstoff | 358/230 |
| 4,385,293 | 5/1983 | Wisnieff | 340/793 |
| 4,390,874 | 6/1983 | Woodside et al. | 340/812 |
| 4,427,978 | 1/1984 | Williams | 340/784 |
| 4,427,979 | 1/1984 | Clerc et al. | 340/805 |

(List continued on next page.)

FOREIGN PATENT DOCUMENTS

| | | | |
|---|---|---|---|
| 0 193 728 A2 | 1/1986 | European Pat. Off. | G09G 3/20 |
| 271960 | 6/1988 | European Pat. Off. . | |
| 0 364 307 A2 | 4/1990 | European Pat. Off. | G09G 3/36 |
| 0 387 033 | 9/1990 | European Pat. Off. | 345/149 |
| 3906924 A1 | 3/1989 | Germany | G09G 3/20 |
| 58-220181 | 12/1983 | Japan . | |
| 58-220182 | 12/1983 | Japan . | |
| 58-220183 | 12/1983 | Japan . | |
| 2204174 | 11/1988 | United Kingdom . | |

OTHER PUBLICATIONS

"New Technologies Sharpen Laptop Displays," International Electronic Design, Feb. 1989, pp. 45–48.*

P. 38, Technical Manual, SED 1341 FOE, 1988, SMOS Systems, Inc.*

S–MOS Systems, Inc. sales brochure for "Dragon Graphic Chip Sets" (Preliminary), undated.*

Maltese, P., et al., "Addressing cycles for fast settling grey shades in ferroelectric liquid crystal matrices", 1988, Ferroelectrics, vol. 85, pp. 653–662.*

Witten, I., et al., "Using Peano Curves for Bilevel Display of Continuous–Tone Images", May 1982, IEEE Computer Graphics and Applications v. 2, n.3, pp. 47–48.*

*Primary Examiner*—Steven Saras

*Attorney, Agent, or Firm*—Alan S. Hodes; Steven A. Shaw

[57] ABSTRACT

A process for producing a wide range of shades in images that are presented in successive frames on image fields on opto-electronic display means having at least one illumination element at each of a plurality of pixel locations. Each pixel location, for example, may have a red, a green and a blue illumination element. The display is divided into uniformly-sized display neighborhoods. The process includes, for a given pixel location within any one of the uniformly-sized display neighborhoods, producing a given shade at that pixel location by selecting a frame sequence for illuminating the illumination elements at the pixel location during presentation of an image wherein the number of times that any given illumination element at the pixel location is illuminated within a given frame sequence is controlled to create an appearance of shading of that pixel location relative to other pixel locations and wherein adjacent pixel locations that have the same shade within any one of the display neighborhoods have their illumination elements illuminated with different frame sequences to minimize display noise.

30 Claims, 4 Drawing Sheets

U.S. PATENT DOCUMENTS

| | | | |
|---|---|---|---|
| 4,486,785 | 12/1984 | Lasher et al. | 358/284 |
| 4,488,150 | 12/1984 | Kanatani | 340/781 |
| 4,516,118 | 5/1985 | Wahlquist | 340/703 |
| 4,559,535 | 12/1985 | Watkins | 340/393 |
| 4,591,848 | 5/1986 | Morozumi | 340/784 |
| 4,640,582 | 2/1987 | Oguchi et al. | 350/333 |
| 4,654,721 | 3/1987 | Goertzel et al. | 358/283 |
| 4,660,030 | 4/1987 | Maezawa | 340/784 |
| 4,695,884 | 9/1987 | Anastassiou et al. | 358/163 |
| 4,706,077 | 11/1987 | Robertz et al. | 340/793 |
| 4,709,995 | 12/1987 | Kuribayashi et al. | 350/333 |
| 4,742,346 | 5/1988 | Gillette et al. | 340/793 |
| 4,743,096 | 5/1988 | Wakai et al. | 350/333 |
| 4,760,387 | 7/1988 | Ishii et al. | 340/716 |
| 4,769,713 | 9/1988 | Yasui | 340/793 |
| 4,775,891 | 10/1988 | Aoki et al. | 358/160 |
| 4,779,083 | 10/1988 | Ishii et al. | 340/767 |
| 4,791,417 | 12/1988 | Bobak | 340/784 |
| 4,797,945 | 1/1989 | Suzuki et al. | 382/56 |
| 4,805,994 | 2/1989 | Miyajima | 350/336 |
| 4,808,991 | 2/1989 | Tachiuchi et al. | 340/793 |
| 4,816,816 | 3/1989 | Usui | 340/784 |
| 4,827,255 | 5/1989 | Ishii | 340/793 |
| 4,840,460 | 6/1989 | Bernot et al. | 350/333 |
| 4,860,246 | 8/1989 | Inoue | 364/900 |
| 4,872,059 | 10/1989 | Shinabe | 358/241 |
| 4,873,516 | 10/1989 | Castleberry | 340/784 |
| 4,908,613 | 3/1990 | Green | 340/719 |
| 4,921,334 | 5/1990 | Akodes | 350/333 |
| 4,929,058 | 5/1990 | Numao | 350/333 |
| 4,956,638 | 9/1990 | Larky et al. | 340/793 |
| 5,006,840 | 4/1991 | Hamada et al. | 340/784 |
| 5,010,326 | 4/1991 | Yamazaki et al. | 304/784 |
| 5,025,400 | 6/1991 | Cook et al. | 364/522 |
| 5,033,822 | 7/1991 | Ooki et al. | 350/331 T |
| 5,068,649 | 11/1991 | Garrett | 340/793 |
| 5,073,966 | 12/1991 | Sato | 382/56 |
| 5,088,806 | 2/1992 | McCartney et al. | 359/84 |
| 5,111,194 | 5/1992 | Oneda | 340/793 |
| 5,122,783 | 6/1992 | Bassetti, Jr. | 340/701 |
| 5,185,602 | 2/1993 | Bassetti, Jr. et al. | 340/793 |
| 5,266,940 | 11/1993 | Shiraishi | 345/149 |
| 5,293,159 | 3/1994 | Bassetti, Jr. et al. | 345/149 |
| 5,298,915 | 3/1994 | Bassetti, Jr. | 345/149 |
| 5,412,395 | 5/1995 | Maeda et al. | 345/149 |
| 5,488,387 | 1/1996 | Maeda et al. | 345/89 |
| 5,552,800 | 9/1996 | Uchikoga et al. | 345/149 |

APPARATUS AND METHOD FOR PRODUCING SHADED IMAGES ON DISPLAY SCREENS

RELATED APPLICATIONS

The present application is a continuation of applications:

1. U.S. Ser. No. 07/813,036, which was filed on Dec. 24, 1991, and commonly assigned herewith now abandoned; and
2. U.S. Ser. No. 07/865,031, which was filed on Apr. 7, 1992, and commonly assigned herewith (which is a continuation-in-part of U.S. Ser. No. 07/813,036 filed Dec. 24, 1991) now abandoned.

BACKGROUND OF THE INVENTION

1. Field of the Invention

The present invention generally relates to processes for providing shaded monochrome and color images on opto-electronic display devices. More particularly, the present invention relates to processes for producing shaded images in successive frames of video information on opto-electronic display devices such as flat-panel LCDs (liquid crystal displays) and similar display devices.

2. State of the Art

In recent years, the computer industry has given significant attention to laptop computer components and, more particularly, to providing laptop computer components with the same functionality as desktop computers. One particular challenge has been the opto-electronic displays, such as flat-panel LCDs (liquid crystal displays) and similar display devices that are employed with laptop computers. Those displays may be monochrome, in contrast to the high-resolution grey scale and color displays that are common in CRT (cathode ray tube) type screens. Even the grey scale or color LCDs that are commercially available are quite expensive and, typically, are capable only of displaying a narrow range of shades.

LCDs and other flat panel display devices differ from CRT devices in two important aspects. First, in operation of a CRT device, an electron beam is driven to scan rapidly back and forth across a screen to sequentially energize selected picture-element (or "pixel") locations along horizontal scanning lines; the net effect of a complete raster of scans is to reproduce snapshot-like "frames" that each contain video data as to the state of each pixel location on each scanning line. The horizontal scanning lines are organized by synchronizing signals, with each frame containing a fixed number of horizontal lines. The frames are reproduced at a standard rate; for example, the frame repetition rate might be sixty frames per second.

In operation of LCDs and similar flat panel display devices, there is no back and forth scanning of an electron beam—in fact there is no electron beam. Instead, such display devices employ arrays of shift registers, with the result that locations anywhere on a screen can be illuminated simultaneously—i.e., at exactly the same instant. Nevertheless, in flat panel display devices as in CRT devices that are employed with microprocessor-based computers, video information is still presented in frames. Each frame normally comprises a field which is 640 pixel locations wide by 480 pixel locations high, and the typical frame repetition rate is sixty frames per second (i.e., 60 hertz).

Also, LCDs and similar flat panel display screens differ from CRT devices in that the illumination intensity (i.e., brightness) at the pixel locations cannot be varied. Instead, the illumination intensity at pixel locations on a flat panel display screen is either "on" or "off." (For present purposes, a pixel location will be considered "on" when the pixel location is illuminated and, conversely, a pixel location will be considered "off" when it is not illuminated.) Thus, when a flat panel display screen is fully illuminated—that is, each pixel location is in its "on" state—the screen will have uniform brightness. (In the following, the term "binary display device" refers to display devices whose picture elements have only two display states either an "on" and an "off" state.)

Because pixel locations on flat panel display screens only have an "on" or "off" state, shading effects cannot be directly produced for images that appear on the screens. To overcome this problem, frame modulation techniques have been employed for simulating grey scale shading of images on binary display devices. Frame modulation techniques basically employ the principal that the frequency with which a pixel location is illuminated determines its perceived brightness and, therefore, its perceived shading. For example, to display a 25% black tone using simple frame modulation, a display element is made active (inactive) in one-quarter of the frames; similarly, to display a tone of 75% black, a display element would be made active (inactive) in three-quarter of the frames. Thus, frame modulation techniques are based upon the principle that, for a picture element having only an active state and an inactive state, when the picture element is made active (or inactive) in a certain fraction of successive frames occurring within a short period of time, the human eye will perceive the picture element as having a tone which is intermediate to tones that are presented when the display element were constantly active (or constantly inactive). The intermediate tones are determined by the percentage of frames in which the display element is active (inactive). Accordingly, when modulation is performed over a sixteen-frame period, then sixteen different tones are simulated.

In summary, it can be said that frame modulation techniques take advantage of persistence and averaging properties of human vision according to which a display element turned on and off at a sufficiently rapid rate is perceived as being continually on and as having a display intensity proportional to the on/off duty cycle of the display element. In conventional practice, frame modulation techniques for producing shading on binary display devices tend to create displays in which the human eye detects considerable turbulence or "display noise".

SUMMARY

The present invention, generally speaking, relates to processes for producing shading in monochrome or multi-color images that are presented in successive frames of video information on flat-panel LCD (liquid crystal display) displays and similar binary display devices. More particularly, the present invention provides a method for simulating shading of images on a display device that has an array of picture elements, each picture element having at least one illumination element, and each illumination element having only two display states, an ON state and an OFF state.

In the preferred embodiment, the present invention provides a process for producing shading in monochrome and multi-color images that are presented in successive frames of video information on flat-panel LCD (liquid crystal display) displays and similar binary display devices while reducing display noise to a minimum. Each pixel location includes at least one illumination element. Multiple illumination elements at pixel location are each of a different color (e.g., red, green and blue). The method of the present invention is accomplished by modulating an ON/OFF duty cycle of one or more illumination elements in each picture element of the array of picture elements during a multi-frame display sequence according to attribute information of respective picture element data to be displayed. The timing of ON/OFF and OFF/ON state transitions of the illumination elements are coordinated within predetermined neighborhoods throughout the array of picture elements such that the state transitions occur substantially uniformly in space and time within a display neighborhood during the multi-frame display sequence. Accordingly, the present invention takes further advantage of the visual averaging property by causing state transitions to occur substantially uniformly in space and time within each neighborhood throughout the array of picture elements during a multi-frame display sequence. In use of the present invention, no individual state transitions, which by themselves constitute only display noise, are perceived; instead, a coherent pattern of state transitions blending is seen that effectively simulates non-monochrome image displays.

BRIEF DESCRIPTION OF THE DRAWINGS

The present invention can be further understood with reference to the following description in conjunction with the appended drawings, in which.

DETAILED DESCRIPTION

Figure 1:
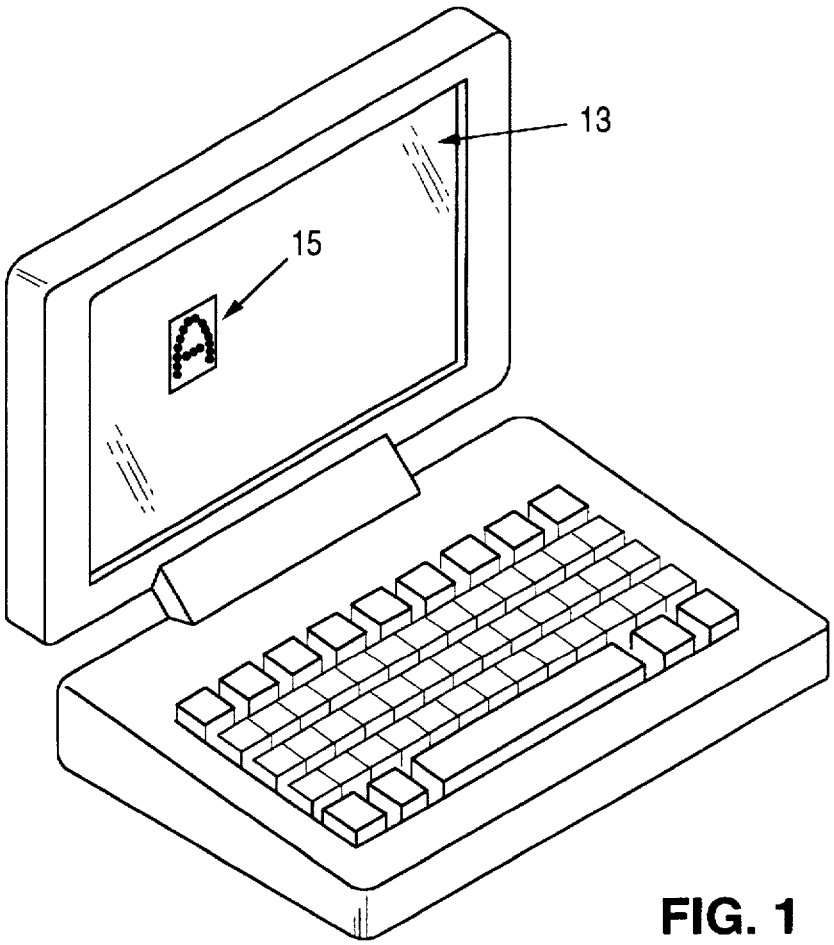
FIG. 1 is a pictorial representation of a display screen having an image field.

FIG. 1 shows an image field 13 that appears on the display screen of a flat-panel LCD or similar binary display device. These display devices, as mentioned above, are characterized by the fact that their pixel locations only have two display states—that is, the pixel locations are either illuminated or not. To produce shading in images that are presented in successive frames of video information on such display screens, the image field is subdivided into two-dimensional, uniformly-sized display neighborhoods, such as will be discussed below in conjunction with FIGS. 2–5.

Figure 2A:
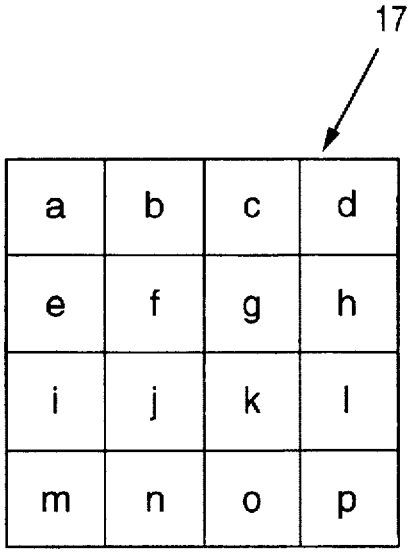
FIG. 2A shows a display neighborhood of the image field of the display screen of FIG. 1, with the display neighborhood being drawn to a highly enlarged scale for purpose of convenience in describing the process of the present invention.
Figure 2B:
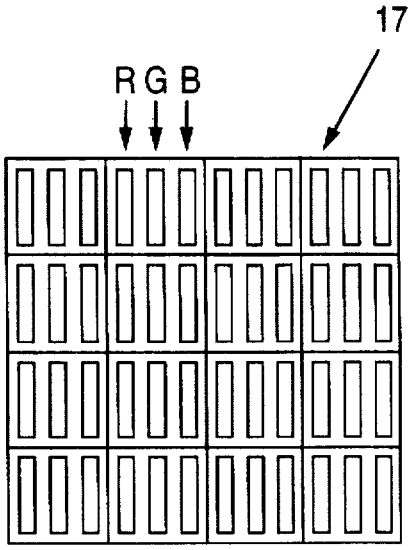
FIG. 2B shows in greater detail the display neighborhood of FIG. 2A, in particular showing the different illumination elements included in each picture element.

For convenience of discussion, the display neighborhood 17 in FIG. 2A is shown to be four pixels wide by four pixels high; in other words, display neighborhood 17 is a square that encompasses sixteen pixel locations. Also for convenience of discussion, the sixteen pixel locations in display neighborhood 17 are labelled as locations "a" through "p". FIG. 2B illustrates the case of a multi-color opto-electronic display device having three illumination elements—namely a red, green and blue illumination element—at each of the pixel locations as seen in FIG. 2B.

Figure 3:
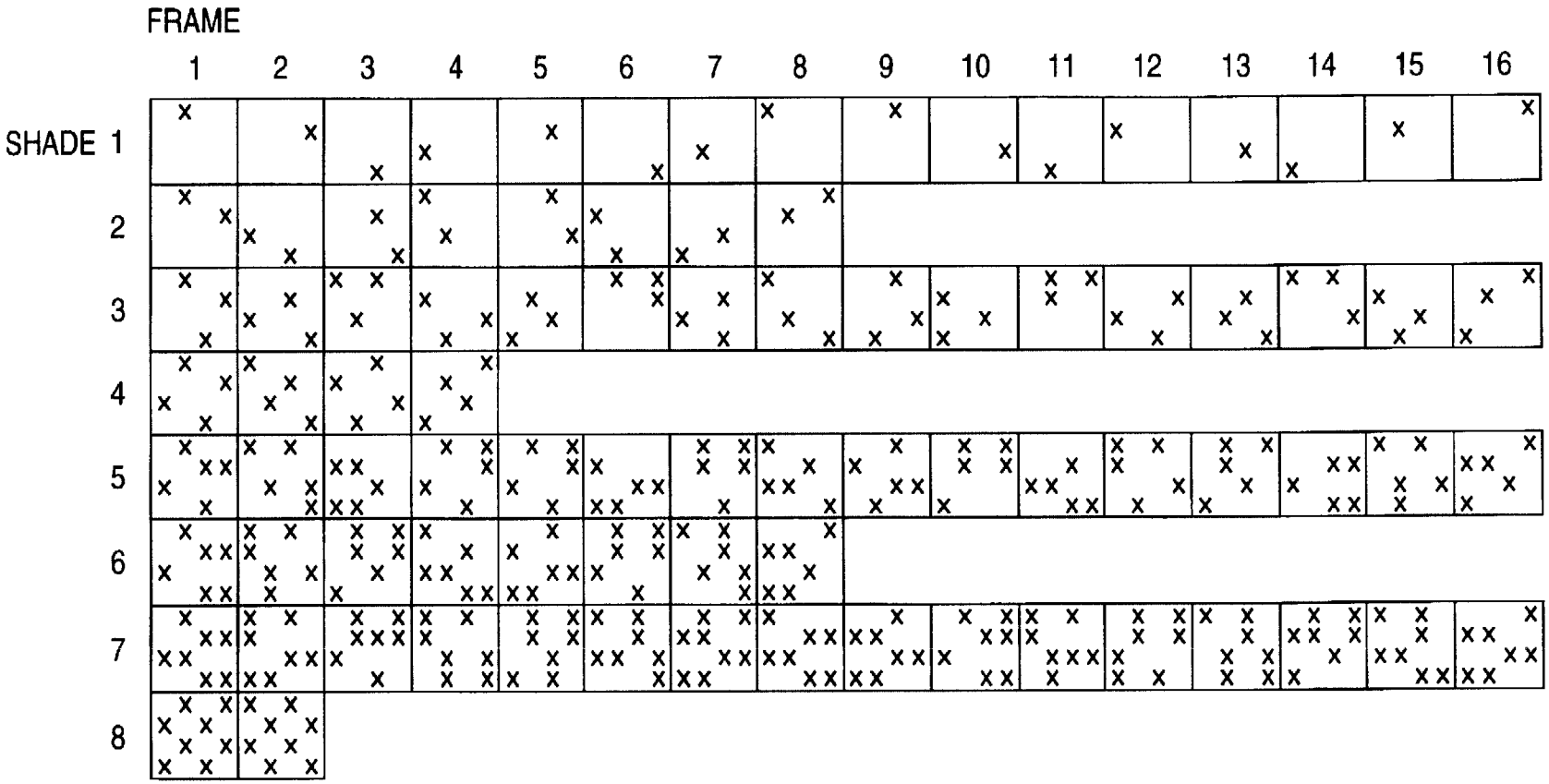
FIG. 3 shows an example of a look-up table for determining an entire frame modulation sequence for each of a number of display tones within a display neighborhood as in FIG. 2.

FIG. 3 shows an example of a look-up table for determining a temporal pattern for illuminating the pixel locations in the display neighborhoods to produce selected shades. In practice, the temporal pattern over which a given illumination element at a pixel location is illuminated is expressed in terms of a "frame sequence". Within a frame sequence, the number of times that a given illumination element at a pixel location is illuminated determines its brightness and, therefore, creates an appearance of its shade relative to other pixel locations.

The look-up table in FIG. 3 is used in conjunction with a frame modulation process whereby the frequency with which a pixel location is illuminated will determine its perceived brightness and, therefore, its shading. For example, if each pixel location has only one illumination element, and if the illumination element at pixel location "a" in FIG. 2A is illuminated only once over a sequence of sixteen frames, that pixel location will appear as a dark shade relative to other pixel locations whose illumination element is illuminated more frequently over the same frame sequence. In a similar way, if the illumination element at pixel location "e" is illuminated three times over a sequence of sixteen frames, that pixel location will appear as a lighter shade (brighter) relative to pixel location "a." Likewise, if the illumination element at pixel location "b" is illuminated four times over a sequence of sixteen frames, that pixel location will appear as a still lighter shade relative to pixel locations "a" and "e." In practice, it is convenient to employ frame sequence that comprises sixteen frames with the frame sequence being repeated between sixty and one-hundred-thirty times per second.

In the look-up table in FIG. 3, the vertical axis indicates shading, from light to dark, over sixteen different shades. In particular, the upper rows of the look-up table show illumination patterns that provide the appearance of lighter shades. The pixel illumination patterns in the lower rows of the look-up table, conversely, provide the appearance of darker shades. The lightest shade will be referred to as shade #1, the next lightest shade will be referred to as shade #2, and so forth.

The horizontal axis in the look-up table in FIG. 3 indicates the frame number. Because a sixteen-frame sequence has been selected in this example, the first column in the table represents the first frame of the sixteen-frame sequence, the second column represents the second frame of the sixteen-frame sequence, and so forth.

Each square area in the look-up table in FIG. 3 shows the state of the illumination element at the pixel locations in the display neighborhood for a selected shading at a given frame number. For example, the look-up table indicates that shade #1 is produced at pixel location "a" by illuminating the illumination element at that pixel location only during the eighth frame of a sixteen-frame sequence. Similarly, the look-up table indicates that shade #1 is produced by illuminating the illumination element at pixel location "f" by illuminating that pixel location only during the fifteenth frame of the sixteen-frame sequence. Or, shade #1 is produced at pixel location "d" by illuminating the illumination element at that pixel location only during the sixteenth frame.

As still another example, the look-up table in FIG. 3 indicates that shade #3 is produced at pixel location "e" by illuminating the illumination element at that pixel location during the fourth, tenth, and fifteenth frames of the sixteen-frame sequence. The look-up table similarly indicates that shade #4 is produced at pixel location "b" by illuminating the illumination element at that pixel location during the first, fourth, ninth and thirteenth frames of the sixteen-frame sequence. Thus, for this example, pixel location "e" will appear lighter than pixel location "a," and pixel location "b" will appear as a still lighter—and this is a result of the fact that the illumination element at pixel location "a" is illuminated once in the sixteen-frame sequence, while the illumination element at pixel location "e" is illuminated three times in the sixteen-frame sequence, and the illumination element at pixel location "b" is illuminated four times in the sixteen-frame sequence. The limit, obviously, is to illuminate the illumination element at the pixel location "b" sixteen times in the sixteen-frame sequence.

Upon examination of the look-up table in FIG. 3, it will be seen that, as a general rule, the illumination element of adjacent pixel locations that have the same shade within any one of the display neighborhoods are illuminated with different temporal patterns over a frame sequence. Thus, continuing with the example above for producing shade #1, the look-up table indicates that the illumination element at pixel location "a" is illuminated only during the eighth frame of the sixteen-frame sequence and that the illumination element at pixel location "b" is illuminated only during the first frame of the sequence. Similarly, for producing shade #3, the look-up table indicates that the illumination element at pixel location "e" is illuminated during the fourth, ninth, and fourteenth frames of the sixteen-frame sequence, while the illumination element at pixel location "f" is illuminated during the fifth, eleventh, and sixteenth frames to produce the same shade.

The conditions under which a given display neighborhood is to be uniformly shaded can now be readily understood. For instance, if an entire display neighborhood is to have shade #3, the look-up table in FIG. 3 indicates that the illumination element at the three pixel locations "b", "h" and "o" are to be illuminated during the first frame of the sixteen-frame sequence; that the illumination at the three pixel locations "g," "i" and "p" are to be illuminated during the second frame; that the illumination element at pixel locations "a," "c," and "j" are to be illuminated during the third frame; and so forth. This example can be extended so that a display neighborhood can have any one of sixteen different shades. Moreover, the same look-up table can be applied to all of the display neighborhoods within an image field.

Figure 4:
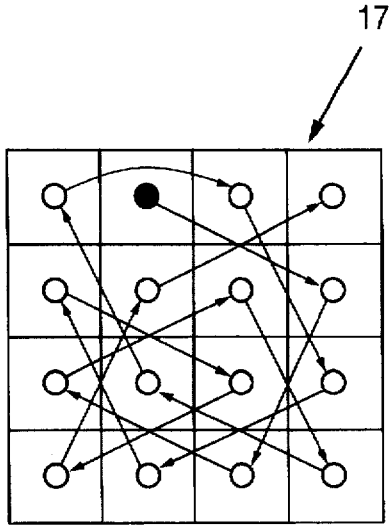
FIG. 4 shows the display neighborhood of FIG. 2 and a preferred pixel transition order within each neighborhood according to the present invention.

FIG. 4 shows an example of a pixel transition order within a display neighborhood. This example is best understood by considering the case where a display neighborhood is to be uniformly shaded with shade #1. In this case, the look-up table of FIG. 3 indicates that the illumination element at the single pixel location "b" is illuminated during a first frame of the sixteen-frame sequence; that the illumination element at the single pixel location "h" is illuminated during the second frame; that the illumination element at the single pixel location "o" is illuminated during the third frame; and so forth. The same pixel transition order can be seen in FIG. 4 and, in fact, that diagram was used as the basis for constructing the look-up table in FIG. 3.

In FIG. 4, the pixel locations whose illumination elements are consecutively illuminated are connected by linear vectors $v_1$, $v_2$, and so forth. Thus, vector $v_1$ extends from pixel locations "b" to pixel locations "h"; vector $v_2$ extends from pixel locations "h" to pixel locations "o"; and so forth. Although the directions of the vectors change from frame to frame, all of the vectors have generally the same length. Accordingly, the distances separating consecutively-illuminated pixel locations are generally equal. This concept of providing generally equal separation distance during transitions is important to taking advantage of the visual averaging property. As a result of employing the pixel transition order shown in FIG. 4 to construct the look-up table in FIG. 3, such that state transitions occur substantially uniformly in space and time within each display neighborhood throughout a array of picture elements during a multi-frame display sequence.

Figure 5:
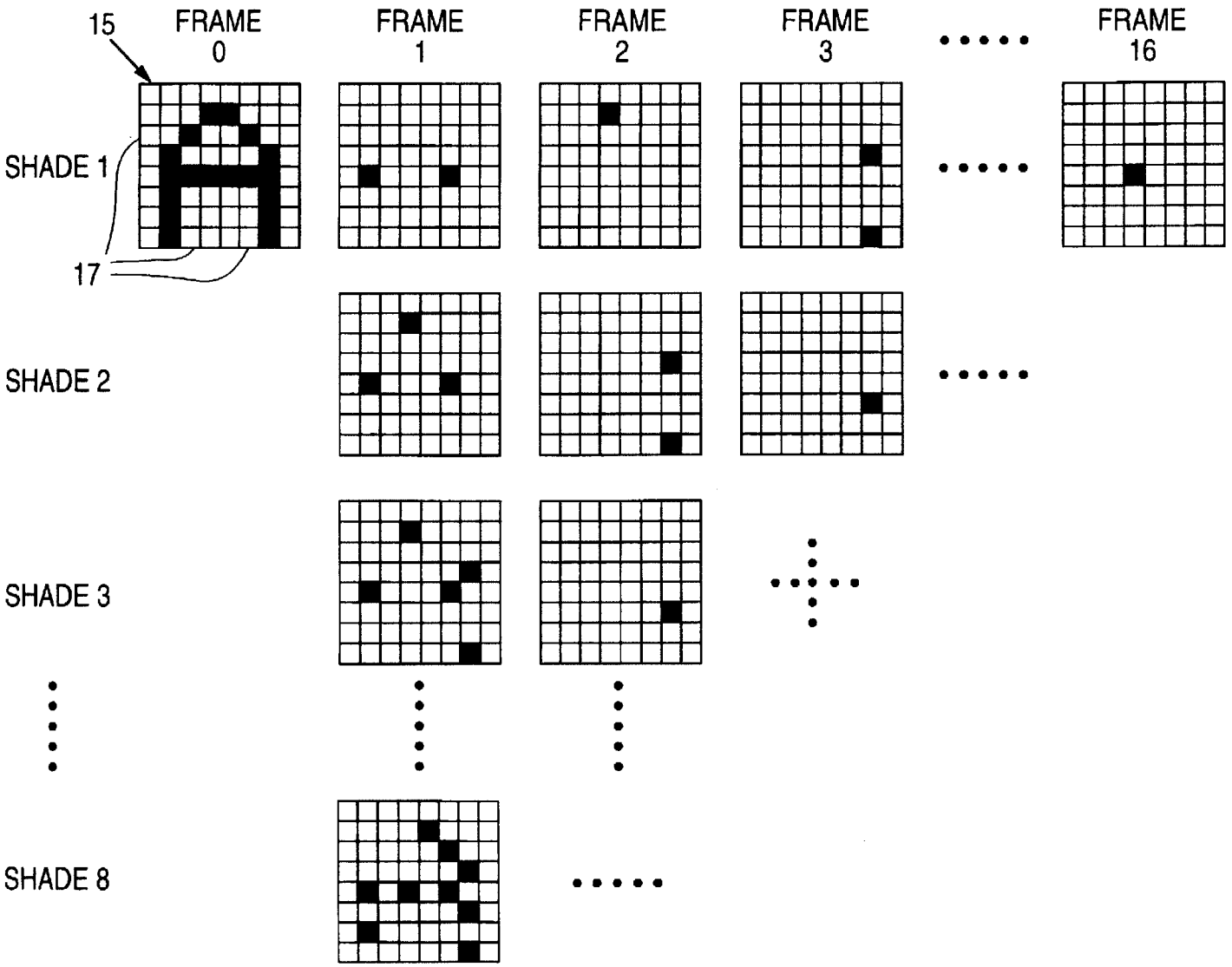
FIG. 5 shows a cluster of four display neighborhoods, with the display neighborhood being drawn to a highly enlarged scale for purpose of further describing the process of the present invention.

In the preceding example, it was assumed that the transition from one shade to another occurred at the beginning of the first frame of a sixteen-frame sequence. In practice, depending upon the image which is to be presented, it may be desired to change the shade of a given pixel location at any frame within a sixteen-frame sequence. FIG. 5 shows an example of producing the letter "A" in a cluster of four display neighborhoods. If the letter "A" is to have shade 1 for the first and second frames and then is to be changed to shade 2 on the third frame, then the shading for that third frame is determined from the look-up table of FIG. 3, according to this example, only one pixel location would have its illumination element illuminated during the third frame to initiate the transition to shade 2.

It should be understood that if the pixels each have three illumination elements (as shown in FIG. 2B), the illumination conditions described in the preceding paragraphs can be accomplished by simultaneously illuminating all three illumination elements (i.e., the red, green and blue illumination elements) at each of the pixel locations. Also, the conditions described in the preceding paragraph can be accomplished by selecting only one of the illumination elements for illumination, as long as the same color element is always selected. For instance, if an entire display neighborhood is to have shade "green #3," the green illumination elements at the three pixel locations "b", "h" and "o" are illuminated during the first-frame of the sixteen-frame sequence; then, the green illumination elements at the three pixel locations "g," "i" and "p" are illuminated during the second frame; next, the green illumination elements at the pixel locations "a," "c," and "j" are illuminated during the third frame; and so forth. An entirely different—and probably unwanted—effect would result from, for instance, illuminating the green illumination elements at the three pixel locations "b", "h" and "o" during the first frame of the sixteen-frame sequence and, then, illuminating the yellow illumination elements at the three pixel locations "g," "i" and "p" during the second frame.

As will now be described, the above-described process can be employed such that any display neighborhood can have any one of 4096 different colors shades. To appreciate the process for arriving at this broad choice of colors, it should be first understood that each illumination element at each pixel location can have one of two states (i.e., either on or off). Thus, each pixel location can have any one of eight colors (i.e., $2^3$ colors). Furthermore, each color can be controlled, as described above, to have one of sixteen different shades. (A seventeenth shade is either all black or all white.) Thus, in the case where the illumination elements have colors red, green and blue, there are choices for any display neighborhood of sixteen shades of red, sixteen shades of green and sixteen shades of blue of each of the eight colors. Any one of the sixteen red shades can be combined with any one of the sixteen green shades—for a total of 162 or 256 shades. Furthermore, any one of those 256 shades can be combined with any one of the sixteen blue shades—for a total of 4096 shades.

In normal practice, however, a given display neighborhood is not usually uniformly shaded but, instead, shading is to be varied from pixel-to-pixel within the display neighborhood. Nevertheless, the look-up table of FIG. 3 also determines how pixel illumination sequences are selected when the shading at a given pixel location changes—that is, when the shading at a given pixel location is to be made lighter or darker. As a concrete example, assume that pixel location "p" has shade #1 and that a transition to shade #2 is to occur at the beginning of the second frame sequence where each sequence comprises sixteen frames. In that case, when producing shade #1, pixel location "p" is illuminated only in the sixth frame of the first frame sequence. In making the transition to shade #2, pixel location "p" is not illuminated again until the third frame of the second frame sequence; then, that pixel location is illuminated again in the eleventh frame, and so forth.

It can now be understood that the present invention provides a method for producing shaded images, whether monochrome or multi-color, in successive frames of video information on opto-electronic display devices such as flat-panel LCDs (liquid crystal displays) and similar display devices that do not intrinsically provide display shades. In use of the present invention, no individual state transitions, which by themselves constitute only display noise, are perceived; instead, a coherent pattern of state transitions blending is seen. It can also be understood now that the method of the present invention is accomplished by modulating the ON/OFF duty cycle of each illumination element in an array of picture elements during a multi-frame display sequence according to attribute information of respective picture element data to be displayed. It is important, as mentioned above, that the timing of ON/OFF and OFF/ON state transitions of the illumination elements of the picture elements are coordinated within neighborhoods throughout the array of picture elements such that the state transitions occur substantially uniformly in space and time within a display neighborhood during the multi-frame display sequence. In other words, advantage is taken of the visual averaging property by causing state transitions to occur substantially uniformly in space and time within each neighborhood throughout the array of picture elements during a multi-frame display sequence. Accordingly, no individual state transitions are perceived; instead, a coherent pattern of state transitions blending is seen.

The foregoing has described the principles, preferred embodiments and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of present invention as defined by the following claims.

What is claimed is:

1. A method of displaying, over a number of consecutive frames, an image with a shade on a display device that includes an array of pixels, each pixel including an illumination element, the method comprising:

providing a display pattern representing the image in an N×M pixel display neighborhood (where N,M≧4) within the array of pixels; and illuminating the illumination element of the pixels of the image in response to the display pattern in accordance with a predetermined illumination sequence, such that i) only one pixel of the image per frame, in the display neighborhood, has its illumination element illuminated, ii) pixels of the image, in the display neighborhood, whose illumination element is illuminated in consecutive frames are a substantially equal number of pixels apart, and iii) the pixels of the image, in the display neighborhood, whose illumination element is illuminated in consecutive frames are at least one pixel apart.

2. The method as in claim 1, wherein the predetermined illumination sequence is further such that iv) over the number of consecutive frames, the illumination element of each pixel of the image, in the display neighborhood, is illuminated in a substantially equal number of frames as the illumination element of each of the other pixels of the image, in the display neighborhood, is illuminated.

3. A method of displaying, over a number of consecutive frames, an image with one or more shades on a display device that includes an array of pixels, each pixel including an illumination element, the method comprising:

providing a display pattern representing the image in an N×M pixel display neighborhood (where N,M≧4) within the array of pixels;

identifying a first predetermined illumination sequence, the first predetermined illumination sequence being such that i) only one pixel of the image per frame, in the display neighborhood, has its illumination element illuminated, ii) pixels of the image, in the display neighborhood, whose illumination is illuminated in consecutive frames are a substantially equal number of pixels apart, and iii) the pixels of the image, in the display neighborhood, whose illumination element is illuminated in consecutive frames are at least one pixel apart; and illuminating the illumination element of the pixels of the image in accordance with a second predetermined illumination sequence, the second predetermined illumination sequence being such that i) the illumination element of only K pixels of the image in the display neighborhood are illuminated in a frame (where K<N×M and not equal to (N×M)/2), and ii) the K pixels whose illumination element is illuminated in the frame correspond to pixels whose illumination element would be illuminated over K consecutive frames of the first predetermined illumination sequence.

4. The method of claim 3, wherein the first predetermined illumination sequence is further such that iv) over the number of consecutive frames, the illumination element of each pixel of the image, in the display neighborhood, is illuminated in a substantially equal number of frames as the illumination element of each of the other pixels of the image, in the display neighborhood, is illuminated.

5. The method of claim 3, wherein the first predetermined illumination sequence is further such that iv) over the number of frames, the numbers of frames between which each particular pixel of the image, in the display neighborhood, whose illumination element is illuminated are substantially equal.

6. A display device that includes an array of pixels, each pixel including an illumination element, for displaying an image with a shade over a number of consecutive frames, the display device comprising:

means for providing a display pattern representing the image for an N×M pixel display neighborhood (where N,M≧4) within the array of pixels; and means for illuminating the illumination element of the pixels of the image in response to the display pattern in accordance with a predetermined illumination sequence, such that i) only one pixel of the image per frame, in the display neighborhood, has its illumination element illuminated, ii) pixels of the image, in the display neighborhood, whose illumination element is illuminated in consecutive frames are a substantially equal number of pixels apart, and iii) the pixels of the image, in the display neighborhood, whose illumination element is illuminated in consecutive frames are at least one pixel apart.

7. The display device of claim 6, wherein the predetermined illumination sequence is further such that iv) over the number of consecutive frames, the illumination element of each pixel of the image, in the display neighborhood, is illuminated in a substantially equal number of frames as the illumination element of the other pixels of the image, in the display neighborhood, is illuminated.

8. A display device that includes an array of pixels for displaying, over a number of consecutive frames, an image with one or more shades, comprising:

means for providing a display pattern representing the image for an N×M pixel display neighborhood (where N,M≧4) within the array of pixels;

means for identifying a first predetermined illumination sequence, the first predetermined illumination sequence being such that i) only one pixel of the image per frame, in the display neighborhood, has its illumination element illuminated, ii) pixels of the image, in the display neighborhood, whose illumination element is illuminated in consecutive frames are a substantially equal number of pixels apart, and iii) the pixels of the image, in the display neighborhood, whose illumination element is illuminated in consecutive frames are at least one pixel apart; and means for illuminating the illumination element of the pixels of the image in accordance with a second predetermined illumination sequence, the second predetermined illumination sequence being such that i) the illumination element of only K pixels of the image, in the display neighborhood, are illuminated in a frame (where K<N×M and not equal to (N×M)/2), and ii) the K pixels whose illumination element is illuminated in the frame correspond to pixels whose illumination element would be illuminated over K consecutive frames of the first predetermined illumination sequence.

9. The display device of claim 8, wherein the first predetermined illumination sequence is further such that iv) over the number of consecutive frames, the illumination element of each pixel of the image, in the display neighborhood, is illuminated in a substantially equal number of frames as the illumination element of each of the other pixels of the image, in the display neighborhood, is illuminated.

10. The display device of claim 8, wherein the first predetermined illumination sequence is further such that iv) over the number of frames, the numbers of frames between which each particular pixel of the image, in the display neighborhood, whose illumination element is illuminated are substantially equal.

11. A method of displaying, over a number of consecutive frames, an image with a color shade on a display device that includes an array of pixels, each pixel including a plurality of illumination elements, each of a different color, the method comprising:

providing a display pattern representing the image in an N×M pixel display neighborhood (where N,M≧4) within the array of pixels; and illuminating a particular color illumination element of the pixels of the image in response to the display pattern in accordance with a predetermined illumination sequence, such that i) only one pixel of the image per frame, in the display neighborhood, has its particular color illumination element illuminated, ii) pixels of the image, in the display neighborhood, whose particular color illumination element is illuminated in consecutive frames are a substantially equal number of pixels apart, and iii) the pixels of the image, in the display neighborhood, whose particular color illumination element is illuminated in consecutive frames are at least one pixel apart.

12. The method as in claim 11, wherein the predetermined illumination sequence is further such that iv) over the number of consecutive frames, the particular color illumination element of each pixel of the image, in the display neighborhood, is illuminated in a substantially equal number of frames as the particular color illumination element of each of the other pixels of the image, in the display neighborhood, is illuminated.

13. A method of displaying, over a number of consecutive frames, an image with one or more color shades on a display device that includes an array of pixels, each pixel including a plurality of illumination elements, the method comprising:

providing a display pattern representing the image in an N×M pixel display neighborhood (where N,M≧4) within the array of pixels;

identifying a first predetermined illumination sequence, the first predetermined illumination sequence being such that i) only one pixel of the image per frame, in the display neighborhood, has a particular color illumination element illuminated, ii) pixels of the image, in the display neighborhood, whose particular color illumination is illuminated in consecutive frames are a substantially equal number of pixels apart, and iii) the pixels of the image, in the display neighborhood, whose particular color illumination element is illuminated in consecutive frames are at least one pixel apart; and illuminating the particular color illumination element of the pixels of the image in accordance with a second predetermined illumination sequence, the second predetermined illumination sequence being such that i) the particular color illumination element of only K pixels of the image in the display neighborhood are illuminated in a frame (where K<N×M and not equal to (N×M)/2), and ii) the K pixels whose particular color illumination element is illuminated in the frame correspond to pixels whose particular color illumination element would be illuminated over K consecutive frames of the first predetermined illumination sequence.

14. The method of claim 13, wherein the first predetermined illumination sequence is further such that iv) over the number of consecutive frames, the particular color illumination element of each pixel of the image, in the display neighborhood, is illuminated in a substantially equal number of frames as the particular color illumination element of each of the other pixels of the image, in the display neighborhood, is illuminated.

15. The method of claim 13, wherein the first predetermined illumination sequence is further such that iv) over the number of frames, the numbers of frames between which each particular pixel of the image, in the display neighborhood, whose particular color illumination element is illuminated are substantially equal.

16. The method of claim 13, wherein said particular color is a first particular color, and a second particular color is different from said first particular color, and further comprising:

identifying a third predetermined illumination sequence, the third predetermined illumination sequence being such that i) only one pixel of the image per frame, in the display neighborhood, has its second particular color illumination element illuminated, ii) pixels of the image, in the display neighborhood, whose second particular color illumination is illuminated in consecutive frames are a substantially equal number of pixels apart, and iii) the pixels of the image, in the display neighborhood, whose second particular color illumination element is illuminated in consecutive frames are at least one pixel apart; and illuminating the second particular color illumination element of the pixels of the image in accordance with a fourth predetermined illumination sequence, the fourth predetermined illumination sequence being such that i) the second particular color illumination element of only L pixels of the image in the display neighborhood are illuminated in a frame (where L<N×M and not equal to (N×M)/2), and ii) the L pixels whose second particular color illumination element is illuminated in the frame correspond to pixels whose second particular color illumination element would be illuminated over L consecutive frames of the third predetermined illumination sequence.

17. The method of claim 16, wherein K is equal to L.

18. The method of claim 16, wherein K is not equal to L.

19. The method of claim 16, wherein the first predetermined illumination sequence is further such that iv) over the number of consecutive frames, the first particular color illumination element of each pixel of the image, in the display neighborhood, is illuminated in a substantially equal number of frames as the first particular color illumination element of each of the other pixels of the image, in the display neighborhood, is illuminated, and wherein the third predetermined illumination sequence is further such that v) over the number of consecutive frames, the second particular color illumination element of each pixel of the image, in the display neighborhood, is illuminated in a substantially equal number of frames as the second particular color illumination element of each of the other pixels of the image, in the display neighborhood, is illuminated.

20. The method of claim 16, wherein the first predetermined illumination sequence is further such that iv) over the number of frames, the numbers of frames between which each particular pixel of the image, in the display neighborhood, whose first particular color illumination element is illuminated are substantially equal, and wherein the third predetermined illumination sequence is further such that v) over the number of frames, the numbers of frames between which each particular pixel of the image, in the display neighborhood, whose second particular color illumination element is illuminated are substantially equal.

21. A display device that includes an array of pixels, each pixel including a plurality of illumination elements, each of a different color, for displaying an image with a color shade over a number of consecutive frames, the display device comprising:

means for providing a display pattern representing the image for an N×M pixel display neighborhood (where N,M≧4) within the array of pixels; and means for illuminating a particular color illumination element of the pixels of the image in response to the display pattern in accordance with a predetermined illumination sequence, such that i) only one pixel of the image per frame, in the display neighborhood, has its particular color illumination element illuminated, ii) pixels of the image, in the display neighborhood, whose particular color illumination element is illuminated in consecutive frames are a substantially equal number of pixels apart, and iii) the pixels of the image, in the display neighborhood, whose particular color illumination element is illuminated in consecutive frames are at least one pixel apart.

22. The display device of claim 21, wherein the predetermined illumination sequence is further such that iv) over the number of consecutive frames, the particular color illumination element of each pixel of the image, in the display neighborhood, is illuminated in a substantially equal number of frames as the particular color illumination element of the other pixels of the image, in the display neighborhood, is illuminated.

23. A display device that includes an array of pixels for displaying, over a number of consecutive frames, an image with one or more shades of a color, comprising:

means for providing a display pattern representing the image for an N×M pixel display neighborhood (where N,M≧4) within the array of pixels;

means for identifying a first predetermined illumination sequence, the first predetermined illumination sequence being such that i) only one pixel of the image per frame, in the display neighborhood, has a particular color illumination element illuminated, ii) pixels of the image, in the display neighborhood, whose particular color illumination element is illuminated in consecutive frames are a substantially equal number of pixels apart, and iii) the pixels of the image, in the display neighborhood, whose particular color illumination element is illuminated in consecutive frames are at least one pixel apart; and means for illuminating the particular color illumination element of the pixels of the image in accordance with a second predetermined illumination sequence, the second predetermined illumination sequence being such that i) the particular color illumination element of only K pixels of the image, in the display neighborhood, are illuminated in a frame (where $K<N\times M$ and not equal to $(N\times M)/2$), and ii) the K pixels whose particular color illumination element is illuminated in the frame correspond to pixels whose particular color illumination element would be illuminated over K consecutive frames of the first predetermined illumination sequence.

24. The display device of claim 23, wherein the first predetermined illumination sequence is further such that iv) over the number of consecutive frames, the particular color illumination element of each pixel of the image, in the display neighborhood, is illuminated in a substantially equal number of frames as the particular color illumination element of each of the other pixels of the image, in the display neighborhood, is illuminated.

25. The display device of claim 23, wherein the first predetermined illumination sequence is further such that iv) over the number of frames, the numbers of frames between which each particular pixel of the image, in the display neighborhood, whose particular color illumination element is illuminated are substantially equal.

26. The display device of claim 23, wherein said particular color is a first particular color, and a second particular color is different from said first particular color, and further comprising:

means for identifying a third predetermined illumination sequence, the third predetermined illumination sequence being such that i) only one pixel of the image per frame, in the display neighborhood, has its second particular color illumination element illuminated, ii) pixels of the image, in the display neighborhood, whose second particular color illumination is illuminated in consecutive frames are a substantially equal number of pixels apart, and iii) the pixels of the image, in the display neighborhood, whose second particular color illumination element is illuminated in consecutive frames are at least one pixel apart; and means for illuminating the second particular color illumination element of the pixels of the image in accordance with a fourth predetermined illumination sequence, the fourth predetermined illumination sequence being such that i) the second particular color illumination element of only L pixels of the image in the display neighborhood are illuminated in a frame (where $L<N\times M$ and not equal to $(N\times M)/2$), and ii) the L pixels whose second particular color illumination element is illuminated in the frame correspond to pixels whose second particular color illumination element would be illuminated over L consecutive frames of the third predetermined illumination sequence.

27. The display device of claim 26, wherein K is equal to L.

28. The display device of claim 26, wherein K is not equal to L.

29. The display device of claim 26, wherein the first predetermined illumination sequence is further such that iv) over the number of consecutive frames, the first particular color illumination element of each pixel of the image, in the display neighborhood, is illuminated in a substantially equal number of frames as the first particular color illumination element of each of the other pixels of the image, in the display neighborhood, is illuminated, and wherein the third predetermined illumination sequence is further such that v) over the number of consecutive frames, the second particular color illumination element of each pixel of the image, in the display neighborhood, is illuminated in a substantially equal number of frames as the second particular color illumination element of each of the other pixels of the image, in the display neighborhood, is illuminated.

30. The display device of claim 26, wherein the first predetermined illumination sequence is further such that iv) over the number of frames, the numbers of frames between which each particular pixel of the image, in the display neighborhood, whose first particular color illumination element is illuminated are substantially equal, and wherein the third predetermined illumination sequence is further such that v) over the number of frames, the numbers of frames between which each particular pixel of the image, in the display neighborhood, whose second particular color illumination element is illuminated are substantially equal.

* * * * *